United States Patent [19]

Glasband et al.

[11] 3,946,863

[45] Mar. 30, 1976

[54] FRAME BOX

[76] Inventors: Norman Glasband, 47 Stoneham Drive, West Hartford, Conn. 06117; Hyman S. Glasband, 80 Braintard Road, West Hartford, Conn. 06114

[22] Filed: Nov. 27, 1974

[21] Appl. No.: 527,639

[52] U.S. Cl. ..... 206/216; 229/1.5 R; 40/152

[51] Int. Cl.[2] ..... B65D 3/00; B65D 77/00

[58] Field of Search ..... 206/216; 229/1.5 R; 40/152

[56] References Cited

FOREIGN PATENTS OR APPLICATIONS 934,754 1/1948 France ..... 206/216

*Primary Examiner*—Davis T. Moorhead

[57] ABSTRACT

A package consisting of an open topped outer box and an inner box which is received within said outer box and cooperates therewith to define a channel between the perimeters of the inner and outer boxes. The inner box includes a cover, on which a decoration may be imprinted or secured, and after the package contents have been removed the cover can be affixed to the inner box and the package used as a wall hanging with the channel between the inner and outer boxes forming a "shadow frame".

4 Claims, 3 Drawing Figures

FIG. 1
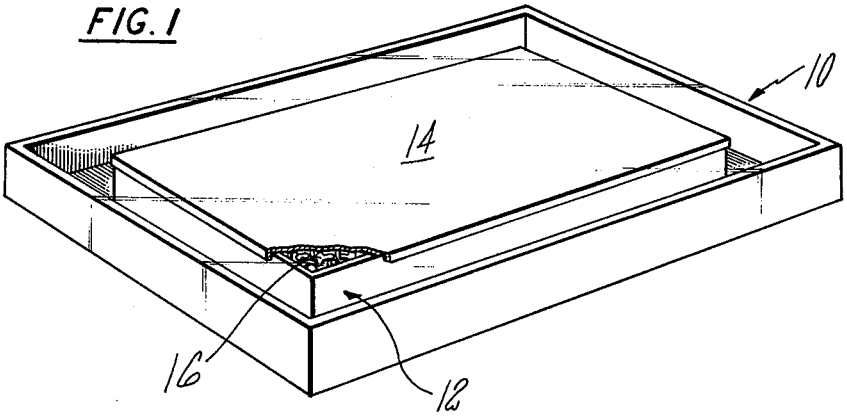
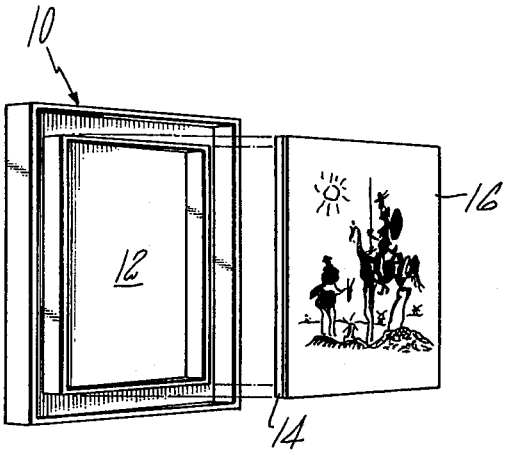
FIG. 2
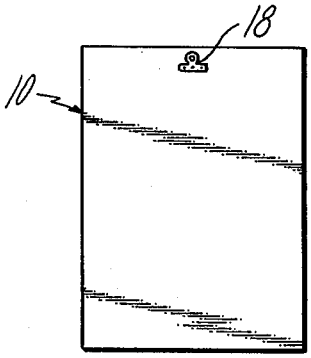
FIG. 3

FRAME BOX

BACKGROUND OF THE INVENTION

1. Field of the Invention

The present invention relates to the packaging of decorative items or craft kit materials which may be formed into decorative items. More specifically, this invention is directed to a box which, when emptied of its contents, may be used as a decorative frame for those contents or some other object. Accordingly, the general objects of the present invention are to provide novel and improved methods and apparatus of such character.

2. Description of the Prior Art

While clearly not limited thereto in its utility, the present invention has been found to be particularly well suited for the packaging of puzzles and, accordingly, will be discussed in connection with this type of handicraft activity. In the past puzzles have typically been packaged in either conventional boxes having complimentary top and bottom sections or open topped box sections with a transparent or similar material stretched thereover to form a retaining cover for the contents of the box. These prior art boxes have, as a general rule, had utility only for storage of the contents in unassembled form. In some cases the box was sized so as to permit assembly of the puzzle therein. However, in the latter case, the intent of the sizing was merely to permit the unfinished puzzle to be moved from location to location or to store a finished puzzle in assembled form. No prior art packages for puzzles or similar craft activities have had secondary utility as a decorative frame whereby the puzzle, when assembled and after treatment with a suitable adhesive or similar material, could be affixed to the package which would serve as a decorative frame suitable for a wall hanging.

SUMMARY OF THE INVENTION

The present invention overcomes the above briefly discussed and other deficiencies and disadvantages of the prior art by providing a novel package for craft materials, and particularly puzzles, wherein the package itself is capable of defining a decorative frame for the assembled contents of the package. In accordance with the invention a package generally comprises a box within a box. The package of the present invention thus consists of an open topped outer box and an inner box which is received within the said outer box; a margin of suitable size and shape being defined between the perimeters of the inner and outer boxes. This margin is in the form of a depression or channel whereby a shadow frame is defined about the inner box. The inner box is provided with a cover for retaining the disassembled puzzle or other craft materials in the package during shipment to the retailer. This cover is commensurate in size with or slightly larger than the inner box. In the case of a puzzle, the pieces may be assembled on the cover and will be affixed thereto by any suitable means. The cover will thereafter be reattached to the inner box and the entire structure may be used as a wall hanging with the aforementioned channel defining, as previously noted, a shadow frame about the assembled puzzle. At the time of the initial packaging of the puzzle the cover will typically be held to the inner box by means of a covering of cellophane or similar packaging material which envelopes the entire package.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which:

FIG. 1 is a perspective view, partly broken away to show the contents, of a package in accordance with the present invention as that package would be presented to a potential purchaser;

FIG. 2 is a exploded perspective view, on a reduced scale, of the package of FIG. 1 after the contents thereof have been assembled by the purchaser; and FIG. 3 is a rear elevation view of the package of FIG. 2.

DESCRIPTION OF THE PREFERRED EMBODIMENT

Referring now simultaneously to FIGS. 1–3, a package in accordance with the present invention comprises an open topped outer box indicated generally at 10. An inner box, indicated generally at 12, is positioned within box 10. Inner box 12 is provided with a cover 14. Cover 14 performs the dual functions of retaining the contents, for example the puzzle pieces indicated in FIG. 1 at 16, within the inner box during shipment and, as indicated in FIG. 2, cover 14 may also form a support backing for the assembled puzzle. In the FIG. 1 embodiment the cover 14 is represented as being maintained in position subsequent to initial packaging by means of a conventional cellophane cover sheet. Cover 14 is provided, about its periphery, with a lip which engages the sides of inner box 12 to enhance the content retention function performed by the cover and, of course, to add strength to the total package.

As may be seen from FIGS. 1 and 2, a margin or channel is defined between the walls of the inner and outer boxes. This margin permits the box to be employed, as indicated in FIG. 2, as a ahadow frame for the contents of the box, when assembled, or any other print or decorative item the purchaser may wish to display. To this end the outer box 10 is provided, at its rear side as indicated in FIG. 3, with means 18 whereby the box may be used as a wall hanging. The hanger 18 may, of course, be packaged in the box and applied to the rear face of box 10 by means of an adhesive by the purchaser.

To facilitate assembly, inner box 12 will typically be provided with a bottom and will be attached to the inside bottom of outer box 10 by means of a suitable adhesive. It would, of course, be possible to define inner box 12 merely through the use of a side wall or walls secured to the bottom of the outer box. It is also to be understood that, while a rectangular package is shown in the drawing as the preferred embodiment, the inner and outer boxes which form the package of the present invention can be any desired shape.

FIG. 2 depicts the puzzle, indicated by pieces 16 of FIG. 1, after assembly and mounting on cover 14. The means by which a puzzle, after assembly, may be formed into an integral picture are well known in the art and will not be discussed herein. Application of puzzle 16 to cover 14 will also be by means of a suitable adhesive.

The box of the present invention has been discussed above principally in terms of its utility in the packaging of items such as puzzles which are assembled by the purchaser. The invention, of course, has much wider utility. Thus, by way of example, the box of the present invention may be employed in the packaging of any item or commodity and the cover 14 may be imprinted with a picture or other decoration whereby the cover may be reinstalled and cemented in position after the package contents have been removed and the container can then be used as a frame for the picture on the cover of the inner box.

While a preferred embodiment has been shown and described various modifications and substitutions may be made thereto without departing from the spirit and scope of the invention. Accordingly, it is to be understood that the present invention has been described by way of illustration and not limitation.

What is claimed is:

1. A package comprising:

an outer box, said outer box including a planar base portion and side wall defining means extending transversely from a first side of said base portion about the periphery thereof;

means defining an inner box, said inner box defining means being secured to said first side of the base portion of said outer box and having a cross-sectional area less than the cross-sectional area of said outer box, said inner box including side wall defining means extending parallel to said outer box side wall defining means, a channel being defined between said inner and outer box side wall defining means, said outer box, said inner box and said channel cooperating to form a shadow frame for a work to be displayed; and a removable cover for said inner box.

2. The package of claim 1 wherein said cover includes a planar portion which is parallel to the base portion of said outer box with the cover positioned on said inner box, said cover further including a downwardly extending lip which engages the side wall defining means of said inner box.

3. The package of claim 2 further comprising:

hanger means affixed to the second side of said outer box base portion.

4. The package of claim 1 further comprising:

hanger means affixed to the second side of said outer box portion.

* * * * *